US006145698A

United States Patent [19]

Meyer

[11] Patent Number: 6,145,698

[45] Date of Patent: Nov. 14, 2000

[54] SEPARATOR FOR THE TOP SHEET OF A STACK AND METHOD FOR ITS ASSEMBLY

[76] Inventor: Alvin Meyer, One Baldwin Ave. #1010, San Mateo, Calif. 94401

[21] Appl. No.: 09/053,413

[22] Filed: Apr. 1, 1998

[51] Int. Cl.[7] ..... B65H 3/00

[52] U.S. Cl. ..... 221/37; 221/210; 221/259; 221/312 C

[58] Field of Search ..... 221/259, 210, 221/220, 305, 312 C, 36, 37; 206/443, 472, 820

[56] References Cited

U.S. PATENT DOCUMENTS

| | | | |
|---|---|---|---|
| 342,181 | 5/1886 | Hoyt | 221/259 |
| 2,268,379 | 12/1941 | Bird et al. | 206/820 |
| 2,269,525 | 1/1942 | Fleischer | 221/210 |
| 2,812,577 | 11/1957 | Leibow | 206/820 |
| 3,035,925 | 5/1962 | Jackson | 206/474 |
| 3,248,006 | 4/1966 | Lowery et al. | 221/36 |
| 4,071,165 | 1/1978 | Leopoldi | 221/259 |
| 4,214,673 | 7/1980 | Heath et al. | 221/261 |
| 4,285,114 | 8/1981 | Underdahl | 221/259 |
| 4,739,902 | 4/1988 | Joslyn et al. | 221/259 |
| 4,997,105 | 3/1991 | Fischer | 221/305 |
| 5,197,630 | 3/1993 | Kirla | 221/210 |
| 5,797,484 | 8/1998 | Sentementes | 206/820 |

*Primary Examiner*—H. Grant Skaggs
*Attorney, Agent, or Firm*—Flehr Hohbach Test Albritton & Herbert LLP

[57] ABSTRACT

A hand held tool to expedite a removal of a single sheet from a stack which may be supplied as a segment of a container or an independent unit and modifications to a container to resist a return of a separated sheet to its original position on the stack.

13 Claims, 5 Drawing Sheets

FIG. 8
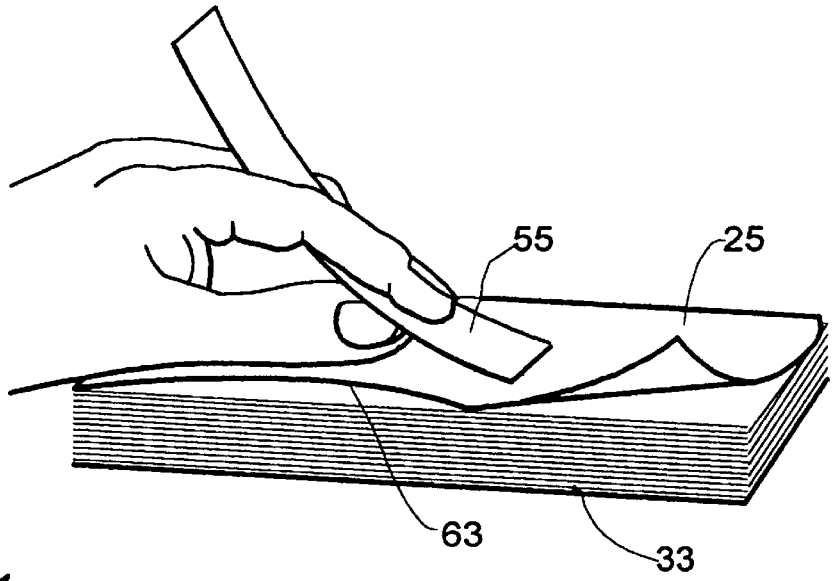
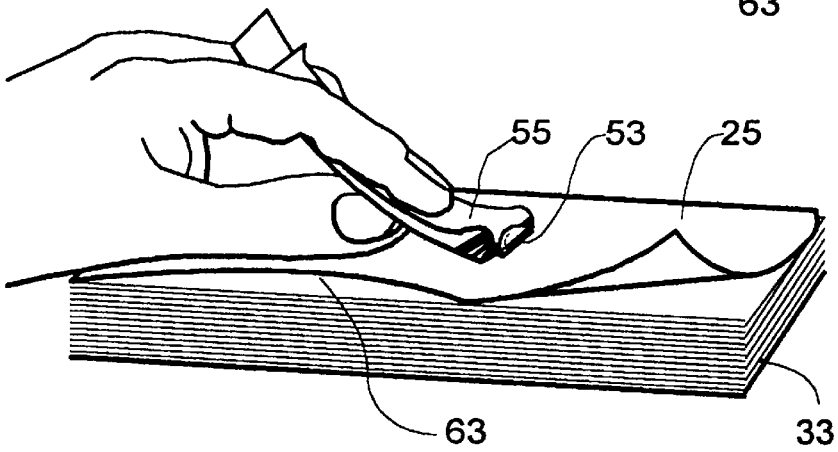
FIG. 9
FIG. 10
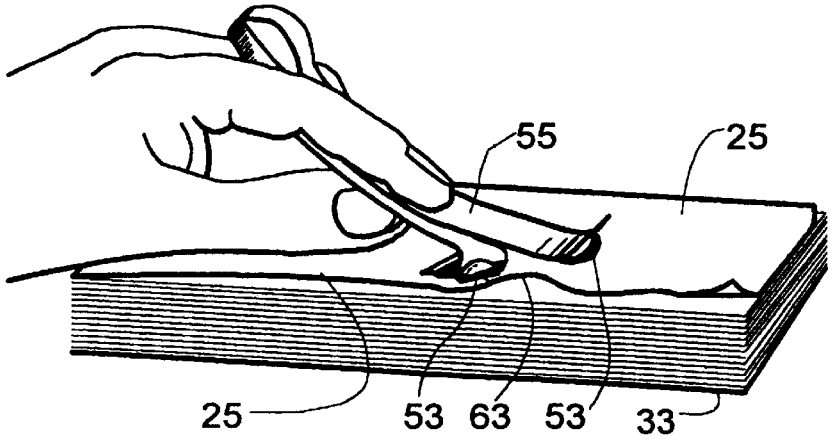

SEPARATOR FOR THE TOP SHEET OF A STACK AND METHOD FOR ITS ASSEMBLY

BACKGROUND

1. Field of Invention

This invention relates to packaging, specifically to packaging sheet stock such as paper, fabric or plastic pages with a device for removing a single sheet and provisions for retaining the residue.

2. Description of Prior Art

Sheet material, such as paper letterheads, films, fabrics and filters, are frequently shipped in a stack enclosed by a box or envelope. A stacked page tends to adhere to its underlying sheet and become difficult to remove as a single unit. When the stacks are die-cut as a group a single sheet's removal is more difficult because the matching edges do not afford a grasping zone.

Forceps formed of molded plastic have been distributed to seize a single sheet but exhibit a tendency to fracture in their hinged zone after repeated usages. Molding thermoplastics requires expensive dies and injection machine times. Mechanically fed devices such as printers and photocopiers use rotating rollers to slide the top sheet toward an operational area. U.S. Pat. No. 5,448,268 (1995) to Cho will show a manual paper-loading device which uses electrically generated charges to effect adherence to the paper. U.S. Pat. No. 4,285,114 (1982) to Underdahl uses electrostatic charges on a plastic plate which matches the outlines of a specific filter.

U.S. Pat. No. 4,629,092 (1986) to English defines a plunger arm pivotally connected to the container's lid and directed by a moment arm to expel a filter with each opening of the lid. U.S. Pat. No. 4,071,165 (1978) to Leopoldi describes an overlying retainer hinge-mounted on a receptacle with a depending member pivotally mounted to engage a sheet. U.S. Pat. No. 4,121,726 (1978) to Pemberton also discloses a mechanically motivated lever. Each of these three requires molding, machining and assembly labor and each is dependent upon the continuing use of a container U.S. Pat. No. 4,362,623 (1982) to Holopainen suggests a thread sinuously interwoven between filters and tabs extending from each margin a design which requires alternating placements of the sheets in the container. U.S. Pat. No. 4,592,840 (1986) to Brooks defines sequentially cut filters each having a connection to its successor and being alternately formed with concave and convex indentations to allow nested folding. The fan-folding requirement prevents economical die cutting of multiple layers. U.S. Pat. No. 4,696,744 (1987) to Sedlacek describes a similar connection between each filter and its successor but proposes to deliver them flat, rolled and indented for user fold lines. The imposition upon the user to tear and fold will challenge the convenience of usage and sanitary status of the filter.

Mr. Coffee™, a manufacturer of nested coffee filters, imprints instructions on its carton to finger riffle the stack to free the top sheet, a procedure which is unsanitary, inconvenient and not uniform in its delivery of single sheets.

My disclosed invention cleanly, conveniently and inexpensively provides a device to dislodge a single sheet from its stack. Also, no modification need by made to existent sheet cutting and shaping mechanisms as this invention will serve many die cut configurations. In addition, the supplemental extensions and cuts in the container's facets may readily be die cut and formed with modest variations to presently used die cutting tools. Alternatively, the same extensions may be cut and formed separately and affixed to the presently cut boxes by adhesives or staples.

The zones having high coefficients of friction may be imprinted or spray painted upon various surfaces using fluid latex. Such zones may be affixed with patches of thin latex or its equivalent material attached to the pawl by adhesives.

The primary embodiment of this invention holds a stack of filters, sheets or films in a sealed package which also encloses the dislodging instrument and minimizes contamination from the user's hands or ambient dust. Other embodiments allow the invented device to serve sheets from a stack without a container. Any of the described embodiments will expedite the counting of sheets. This invention provides a surface which may be advantageously used for instructions or advertisements.

OBJECTS AND ADVANTAGES

Accordingly, several objects and advantages of the present invention are:

(1) to provide an improved device for manually separating stacked sheet material to singularly release the topmost sheet, (2) to provide a manually operated device for separating stacked sheets which is delivered to the end user as a detachable segment of the stack container, (3) to provide a manually operated separating device for stacked sheets which is a continuation of the container for the sheets and remains attached to the container, (4) to provide a manually operated separating device for stacked sheets which may be enclosed as a separate unit within the container for the sheets, (5) to provide a manually operated separating device for stacked sheets which is economical, (6) to provide manually operated separating devices in groups with disposable components and (7) to provide a manually operated separating device for stacked sheets which may bear an imprinted message.

Further objects and advantages will become apparent to those skilled in the arts from the text and drawings accompanying this specification.

DESCRIPTION OF DRAWING FIGS. 1 TO 17

FIG. 1 An isometric view of a carton 21 with the flap 37–39 of the lid 41 divided into sections by perforations 49,49 to provide for a gummed sealing area 37, a removed working strip and a residual tab 39 for subsequent closures.

FIG. 2 A view of the underside of extension 45 as shown in FIG. 1 with an adhesive patch 53 or abrasive patch 57 in its distal segment.

FIG. 3 An isometric section of container 21 of FIG. 1 with retentive flange folded inward to a functionally retentive position.

FIG. 4 An enlarged section of flange 27 of FIG. 3 showing multiple engagements of the stack by tabs 31 within tabs 29.

FIG. 5 A sectional view at A—A of FIG. 3 showing flange 27 folded inwardly and tabs 29 and 31 inwardly indented to present retentive surfaces against the stack 33.

FIG. 6. An isometric view of container 21 with lid 41 in its closed position and with flange 37–39 in its sealed position and with tool 45 partially removed along parallel perforated lines 49,49.

FIG. 7. An isometric view of an embodiment showing opened container 21 with tool 45 extending from accordion folds 47 to flange 51 and then to side wall 53 without retentive tabs in its opposing wall.

FIG. 8. A stack of sheets 33 removed from its container with tool 55 as shown in FIG. 6 being wiped across the planar surface of top sheet 25 to buckle 63 top sheet.

FIG. 9 A stack of sheets 33 removed from its container with tool 55 as shown in FIG. 11 having been folded double to expose frictional patch 53 and wiped across the planar surface of top sheet 25 to buckle 63 top sheet.

FIG. 10 A stack of sheets 33 removed from its container with tool 55 as shown in FIG. 14 having been folded double to expose frictional patches 53, 53 and being wiped each toward the other across the planar surface of top sheet 25 to buckle 63 top sheet.

FIG. 11 Tool 55 supplied independent of the container with frictional patch 53 centrally positioned.

FIG. 12 Tool 55 supplied independent of the container with frictional patch 53 peripherally positioned.

FIG. 13 Tool 55 supplied independent of the container with an abrasive patch 57 centrally positioned.

FIG. 14 Tool 55 supplied independent of the container with frictional patches 53,53 peripherally positioned at two ends.

FIG. 15 Tool 55 supplied independent of the container with frictional patch 53 extending throughout most of its working surface.

FIG. 16 A wand 59 capped with frictional or abrasive materials 53.

FIG. 17 A series of wands 57 as in FIG. 16 packaged in multiples

| Reference numbers- | |
|---|---|
| 21 | Container |
| 23 | Wrapper, multiple wands |
| 25 | Top sheet, filter or film |
| 27 | Flange, side wall |
| 29 | Retainer tab, outer |
| 31 | Retainer tab, inner |
| 33 | Stack or nest of sheets |
| 35 | Side wall, near |
| 37 | Flange, container lid, sealed segment |
| 39 | Flange, container lid, secondary closing segment |
| 41 | Flange, lid |
| 43 | Side wall, left |
| 44 | Side wall, right |
| 45 | Tool |
| 47 | Accordion pleats |
| 49 | Tear lines, perforated |
| 51 | Flange, from side wall |
| 53 | Patch of frictional or abrasive material |
| 55 | Tear strip to become tool |
| 56 | Cover sheet for wands |
| 57 | Wand |
| 58 | Series of wands |
| 59 | Cap, frictional or abrasive material |
| 63 | Buckle induced in the top sheet |

DESCRIPTION OF THE FIGURES

The embodiment of FIG. 1–5 shows an abrasive or frictionally active patch 53 underlying a carton extension 45 which extension is flexibly attached by a series of fluted or folded segments 45–47 to the flap 51 of a carton side wall 43 to form a tool 45. Tool 45 is an extension of one of many walls constituting a container for sheet stock 33. The cover lid 41 has a continuing segment 39 divided by parallel perforated tear-lines 49 to provide a distal segment 37 and a tear-away middle segment 55. Other side walls 44 continue as flaps 27 having nested semicircular cutouts 29, 31 which incline toward the container's contents.

Frictional material 53 is a layer of material having a high coefficient of friction such as rubber or abrasives 57 such as beach sand, powdered glass or crystalline resins affixed with adhesive compounds in the manner of sandpaper.

Figure 15:
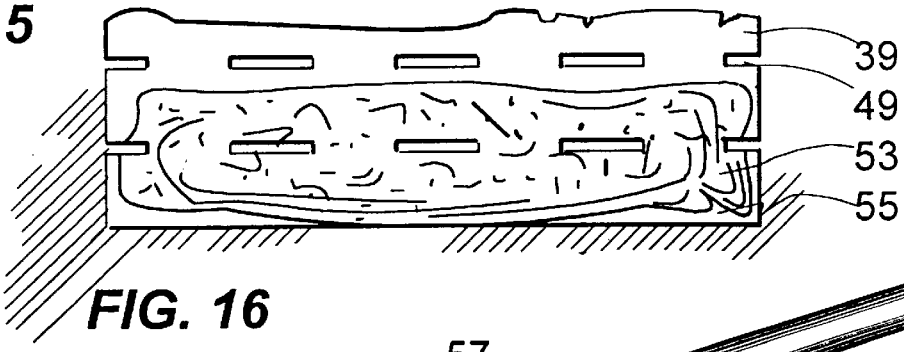
Figure 16:
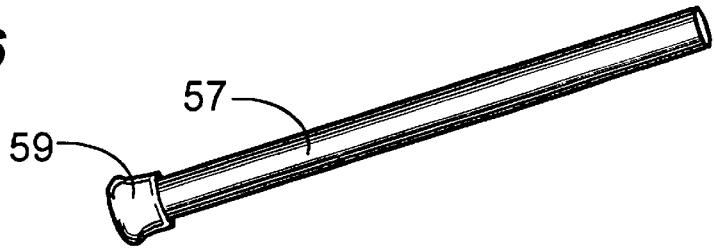

Container side wall 35 of FIG. 7 underlying the removable strip is selectively prepared with a parting agent such as wax or silicone to permit sealing the distal segment 37 with the same application of frictional compound that, subsequently, will provide a frictional zone 53 on the strip as in FIG. 15.

Figure 6:
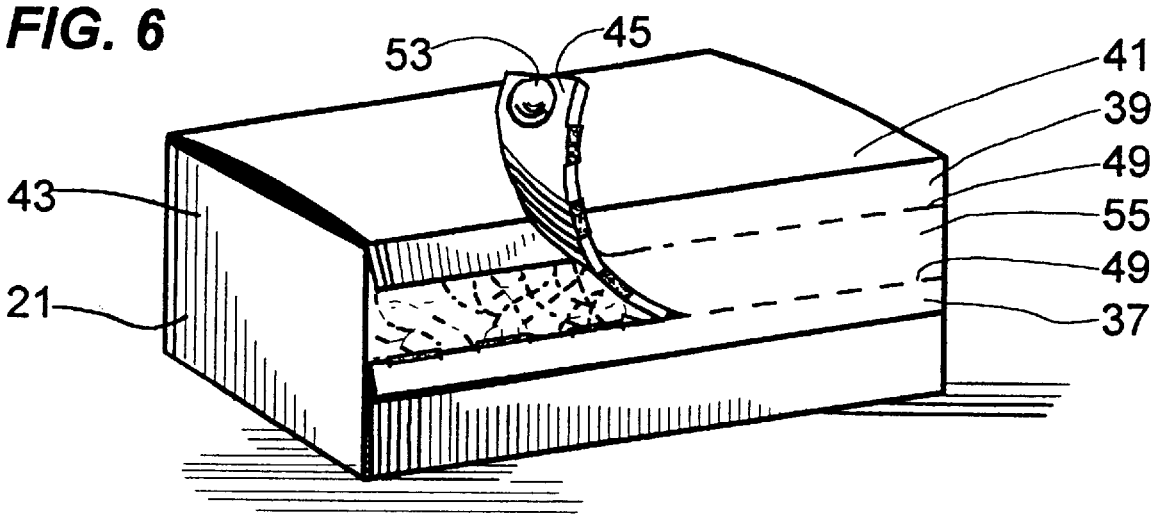

The embodiment of FIG. 6 demonstrates simple flaps at 27 and 51 with the tear-away strip 55 having a frictional patch 53 as exemplified in FIGS. 11–15 being partially removed.

Figure 1:
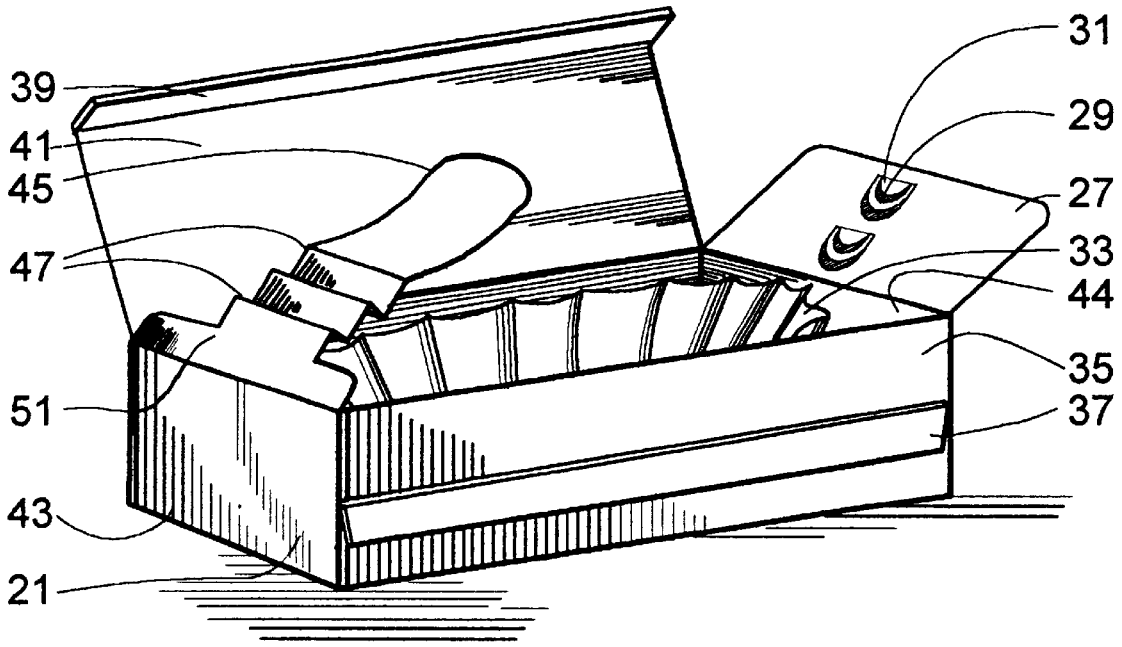
Figure 2:
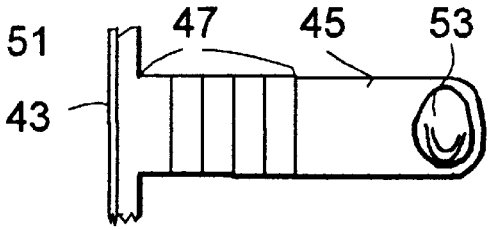
Figure 4:
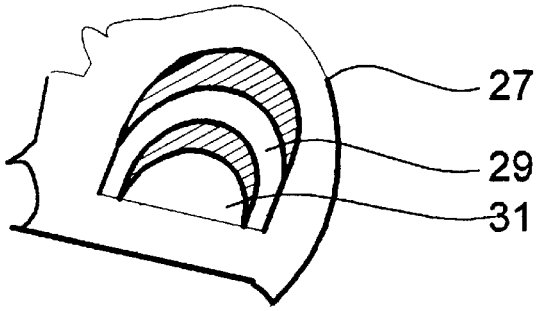
Figure 3:
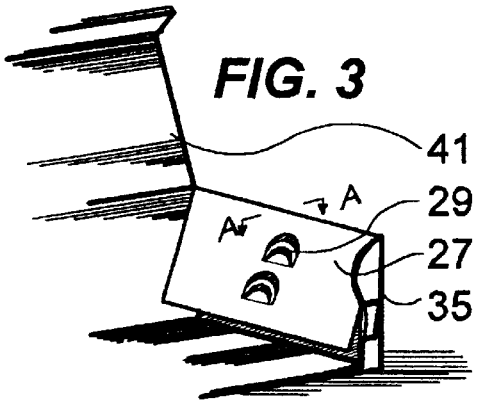
Figure 5:
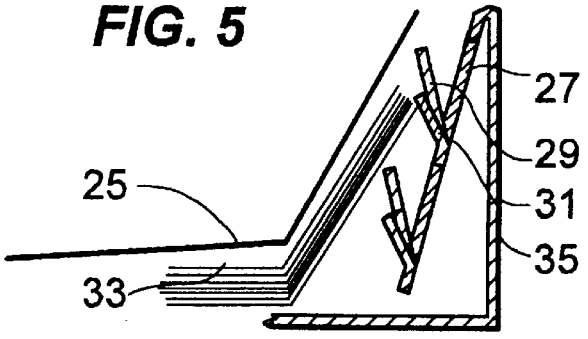
Figure 7:
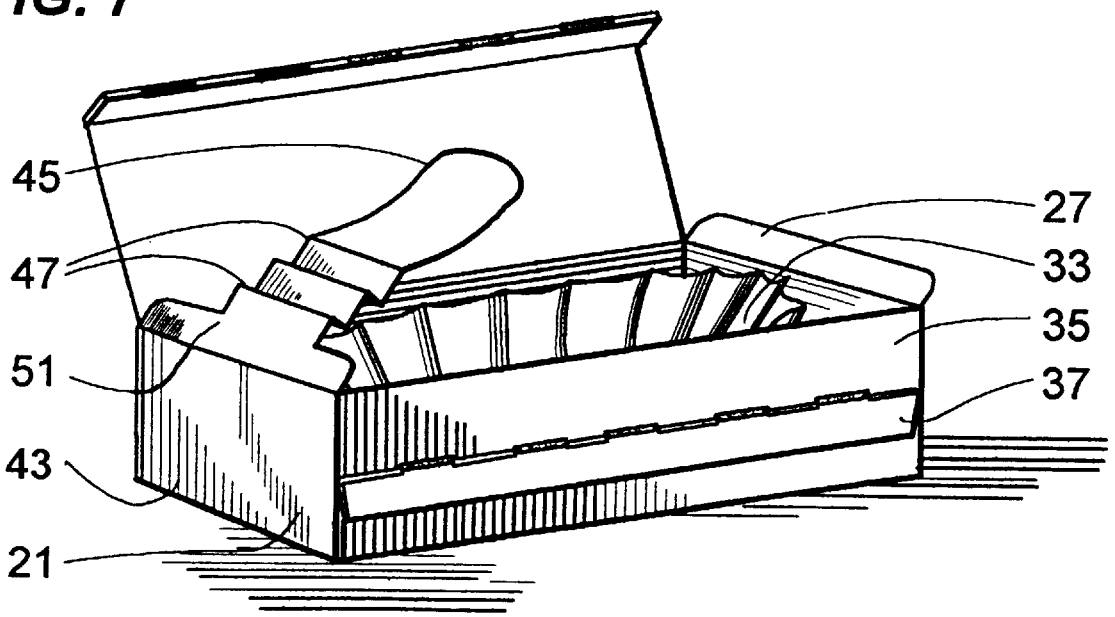
Figure 11:
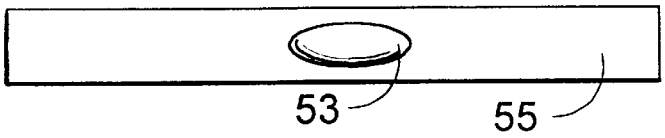
Figure 12:
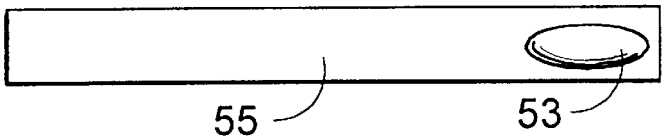
Figure 13:
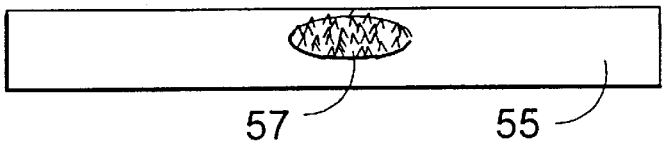
Figure 14:
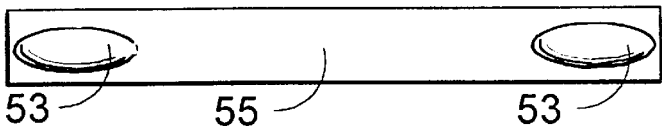

The embodiment of FIG. 7 is similar to that of FIG. 1. but flap 27 does not have retentive tabs.

FIGS. 8–10 demonstrate the removed tool 55 in three usage patterns.

Figure 17:
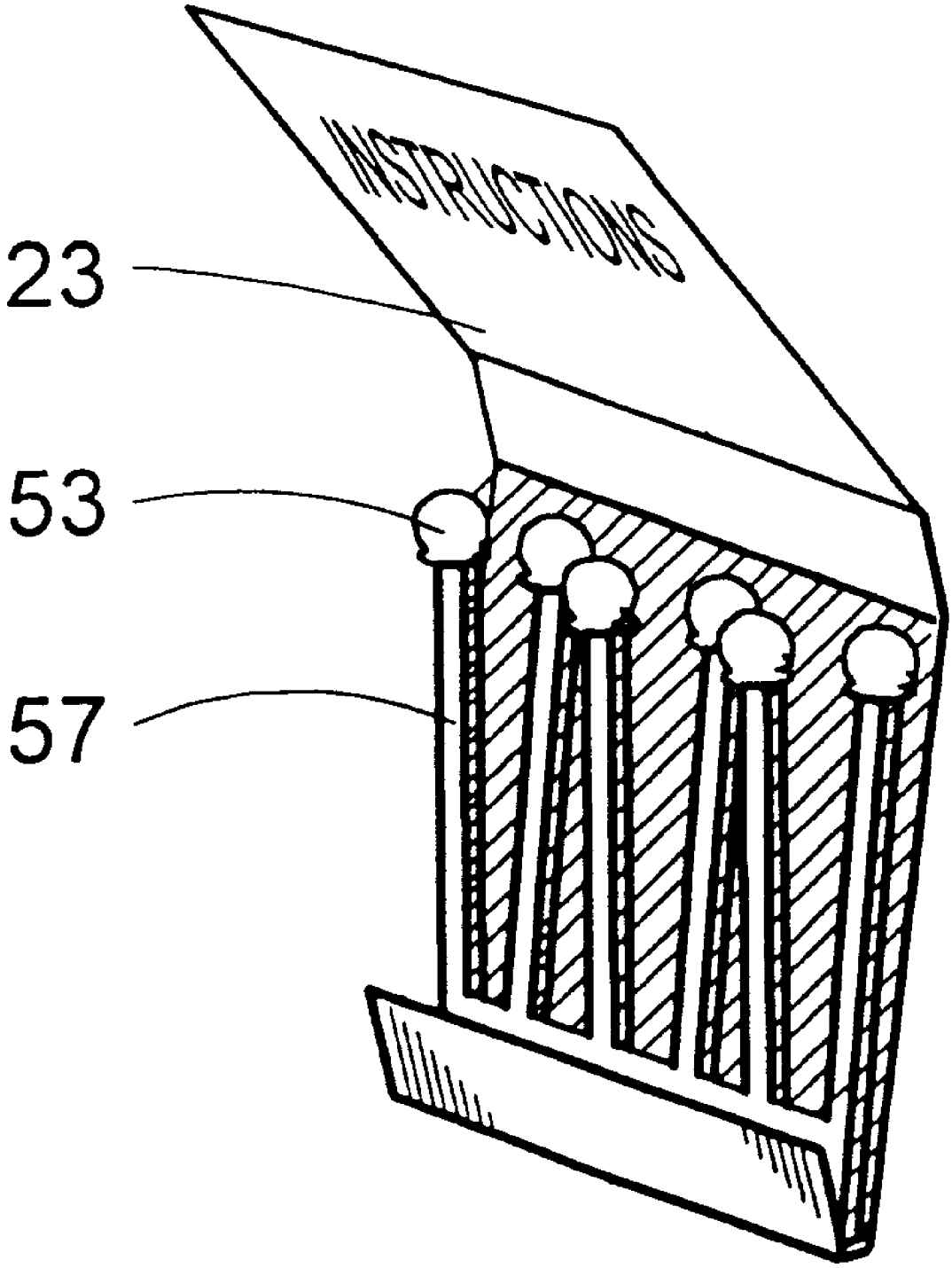

The embodiment of FIG. 17 designs a series of wands 57 mounted in the manner of pad matchbooks 23 to permit clean storage for pending removal of a wands when needed.

DESCRIPTION OF THE INVENTION

Operation

A frictionally effective or abrasive patch on a tool may be pushed or drawn laterally by hand across a stack within or outside of a container to cause a shifting and buckling of the first sheet and thereby expose an edge which may be conveniently grasped for the removal of a single sheet. In other embodiments, both ends, selected middle sections or the entire length of the strip may be coated with frictional material and the strip may be folded to provide engaging or clasping surfaces.

In other embodiments, the tool may be an extension of any free edge of the container. Yet another embodiment provides a tool as an extension of a side wall attached with accordion folds to provide the flexibility needed for a wiping action without detaching the tool.

A variation of the described embodiments is a tool with no attachment to the container which may be enclosed with the stack or may be a separately packaged entity.

Summary, Ramifications, and Scope

An tool, useful to dislodge a single sheet from a stack, which may be fabricated as an attached segment of a container or be included with a stack and which may participate in both sealing and opening of a container. Use of the device does not mar or pierce the contacted sheet.

I claim:

1. A container for a plurality of stacked sheets, said container comprising a bottom, a first sidewall upstanding from said bottom, a second sidewall upstanding from said bottom opposite said first sidewall, a front sidewall upstanding from said bottom extending between said first and second sidewalls, a rear sidewall upstanding from said bottom extending between said first and second sidewalls and parallel to and opposite said front sidewall, a lid hinged to an edge of said rear sidewall opposite said bottom, said lid when opened providing access to said sheets from a top of said container for withdrawal of at least one sheet from said container without wrinkling said one sheet, a flange integral with and hinged to an edge of said first sidewall opposite said bottom extending into said container above said stack and below said lid, and a patch of sheet gripping material on an area of said flange to grip a topmost sheet to separate said topmost sheet from underlying sheets of said stack.

2. A container according to claim 1 in which said flange is flexible so that it may be moved relative to said stack toward and away from said first said end.

3. A container according to claim 1 in which said flange is formed with pleats.

4. A container according to claim 1 which further comprises a second flange integral with and hinged to said second sidewall, said second flange being formed with a retainer tab, said second flange being movable to a position between said second sidewall and said stack with said retainer tab positioned above an adjacent edge of said topmost sheet.

5. A container according to claim 2 which further comprises a second retainer tab on said second flange spaced from said first-mentioned retainer tab.

6. A container according to claim 1 in which said sheet gripping material is frictionally active material.

7. A container according to claim 1 in which said gripping material is abrasive.

8. A container according to claim 1 in which said lid has a flap adhering to said front sidewall.

9. A container according to claim 8 in which said flap has adhesive adhering a portion of said flap remote from said lid to said front sidewall and is formed with a tear strip above said adhesive whereby said tear strip may be removed and said lid may be opened.

10. A container for a plurality of stacked sheets, said container comprising a bottom, a first sidewall upstanding from said bottom, a second sidewall upstanding from said bottom opposite said first sidewall, a front sidewall upstanding from said bottom extending between said first and second sidewalls, a rear sidewall upstanding from said bottom extending between said first and second sidewalls and parallel to and opposite said front sidewall, a lid hinged to an edge of said rear sidewall opposite said bottom, said lid when opened providing access to said sheets from a top of said container for withdrawal of at least one sheet from said container without wrinkling said one sheet, a flap hinged to said lid adhering to said front sidewall, a portion of said flap remote from said lid being adhered to said front sidewall in an adhering zone, said flap being formed with a tear strip above said zone, whereby when said tear strip is removed said lid may be opened, and a patch of gripping material applied to a surface of said tear strip, whereby said tear strip may be used as a tool to separate a topmost of said sheets from said stack.

11. A container according to claim 10 in which said sheet gripping material is frictionally active.

12. A container according to claim 10 in which said sheets gripping material is abrasive.

13. A container according to claim 10 in which said gripping material is adhesive and in which a portion of said gripping material extends downward into a portion of said flap remote from said lid to adhere said portion to said front sidewall.

* * * * *